US006802439B2

(12) United States Patent
Azam et al.

(10) Patent No.: US 6,802,439 B2
(45) **Date of Patent: *Oct. 12, 2004**

(54) LACE-UP TIGHTENING DEVICE FOR AN ARTICLE OF FOOTWEAR, AND AN ARTICLE OF FOOTWEAR EQUIPPED WITH SUCH DEVICE

(75) Inventors: Guy Azam, Aix-les-Bains (FR); Jean-Bruno Danezin, Chilly (FR); Eric Pierre, Annecy (FR); Bruno Borsoi, Victorio Veneto (IT)

(73) Assignee: Salomon S.A., Metz-Tessy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/926,086

(22) PCT Filed: Dec. 22, 2000

(86) PCT No.: PCT/FR00/03661

§ 371 (c)(1),
(2), (4) Date: Sep. 19, 2001

(87) PCT Pub. No.: WO01/47386

PCT Pub. Date: Jul. 5, 2001

(65) Prior Publication Data

US 2003/0034365 A1 Feb. 20, 2003

(30) Foreign Application Priority Data

Dec. 28, 1999 (FR) ..... 99 16846
May 26, 2000 (FR) ..... 00 06960

(51) Int. Cl.[7] ..... A47G 25/80

(52) U.S. Cl. ..... 223/113; 36/50.5

(58) Field of Search ..... 223/85, 113; 24/712, 24/712.1, 712.4, 713; 36/50.5, 56

(56) References Cited

U.S. PATENT DOCUMENTS

| | | | | | |
|---|---|---|---|---|---|
| 4,200,998 | A | | 5/1980 | Adams | 36/50 |
| RE31,052 | E | | 10/1982 | Adams | 36/50 |
| 4,791,702 | A | * | 12/1988 | McVey | 16/428 |
| 4,967,454 | A | * | 11/1990 | Elieff | 24/712.1 |
| 5,477,593 | A | | 12/1995 | Leick | 24/712.5 |
| 5,956,823 | A | | 9/1999 | Borel | 24/712.9 |
| 5,979,080 | A | | 11/1999 | Borsoi | 36/50.1 |
| 6,467,195 | B2 | * | 10/2002 | Pierre et al. | 36/50.5 |
| 2001/0025434 | A1 | | 10/2001 | Fellouhe | |

FOREIGN PATENT DOCUMENTS

| | | | | |
|---|---|---|---|---|
| DE | 8714500 | | 12/1987 | |
| DE | 19710102 | | 9/1998 | |
| DE | 19710702 | A1 * | 9/1998 | A43C/3/02 |
| EP | 0923886 | | 6/1999 | |
| EP | 1034712 | | 9/2000 | |
| FR | 2473280 | | 7/1981 | |
| FR | 2706743 | | 12/1994 | |
| FR | 2752686 | | 3/1998 | |
| FR | 2757026 | | 6/1998 | |

* cited by examiner

*Primary Examiner*—John J. Calvert
*Assistant Examiner*—James Smith
(74) *Attorney, Agent, or Firm*—Greenblum & Bernstein, P.L.C.

(57) ABSTRACT

A lace-up device for tightening an article of footwear, providing for the tieing of the lacing without causing discomfort to the user's hands, as well as to the article of footwear equipped with such device. The lace-up device includes a gripping mechanism arranged on the linkage in the area of a loop formed by the lacing outside the tightening zone. The gripping device includes a rigid frame, making it possible to distribute the tension of the lacing over the hand of the user.

46 Claims, 3 Drawing Sheets

LACE-UP TIGHTENING DEVICE FOR AN ARTICLE OF FOOTWEAR, AND AN ARTICLE OF FOOTWEAR EQUIPPED WITH SUCH DEVICE

BACKGROUND OF THE INVENTION

1. Field of the Invention

The invention relates to a tight lace-up device using a lace-type linkage and adapted to equip an article of footwear used, in particular, but in a non-limiting fashion, in sporting activities. The invention also relates to such article of footwear equipped with such device. Tight lacing, according to the invention, is more specifically adapted to shoes whose upper is reinforced, and which are used in particular for snowboarding, in-line roller skating, alpine skiing, mountain skiing and telemark skiing, ice skating, etc.

2. Description of Background and Relevant Information

To tighten a shoe of the aforementioned type properly, it is necessary to tie the lace tightly. In addition, using a lace-type tightening makes it possible to preserve a lightweight and inexpensive system, as compared to the other mechanical locking means, such as buckles. However, to obtain a tight lacing, it is necessary to reduce the friction of the lace in the lace returns. The improved sliding occurs in particular by reducing the section of the lace, which reduces the friction contact surface. Nevertheless, the small section of the lace tends to cause a painful shearing effect in the hand, and this prevents the user from applying enough tension in order to efficiently tighten the shoe.

French Application Publication No. 2 752 686 proposes a first alternative by describing a lace having variable sections. The central portion is small in diameter so as to slide easily in the returns, and the ends of the lace have larger sections in order to provide greater comfort for the hands. However, even though this system makes it possible to tension the lace correctly, it does not make it possible to maintain the tension due to a locking of the lace by a knot. Indeed, during the time necessary required for tying the knot, the user is forced to release the tension in the lace. Furthermore, the system is expensive to implement, for it requires specific means for manufacturing the lace.

French Application Publication No. 2 706 743 describes a lace-up device where the lace, having a small cross section, passes in returns, minimizing the friction and forms a loop. The lace is locked by an independent locking element that slides along the lace outside the lacing zone. The locking element makes it possible to maintain the tension in the lace. However, the user cannot apply a substantial tension in the lace. Indeed, the user is forced to grab the loop of the lace with at least one finger and to pull on the lace, which quickly shears the skin due to the small diameter of the lace.

SUMMARY OF THE INVENTION

One of the objects of the present invention is to propose a lace-up device for an article of footwear using a linkage that makes it possible to ensure a tight lacing, while preserving the user's comfort during the tightening phase.

Another object of the invention is to propose an inexpensive lace-up device that does not require the use of specific means to manufacture the linkage.

To achieve these objects, the lace-up device according to the invention includes a linkage that connects, along a predetermined path, at least two return elements arranged on different portions of the article of footwear to be brought closer together, and which forms a loop located outside the tightening zone. The linkage is equipped in the area of the loop with a gripping device that enables the user to pull efficiently on the linkage with at least one hand. This gripping device includes a rigid frame, making it possible to distribute the tension of the linkage over the hand. In addition, this lace-up device includes a locking mechanism integrated into the return elements that is positioned at the junction of the lacing zone and of the loop. Thus, the user can maintain the tension in the linkage and, therefore, in the lacing zone, during the locking.

In a first embodiment, the gripping device is positioned at one of the ends of the tightening zone.

In a second embodiment, the gripping device is positioned perpendicular to the tightening zone.

BRIEF DESCRIPTION OF DRAWING

The invention will be better understood and other advantages thereof will become apparent from the description that follows, with reference to the annexed drawings, whereby the description illustrates, by way of non-limiting examples, certain preferred embodiments. The drawings include the following views.

DETAILED DESCRIPTION OF THE INVENTION

Figure 1:
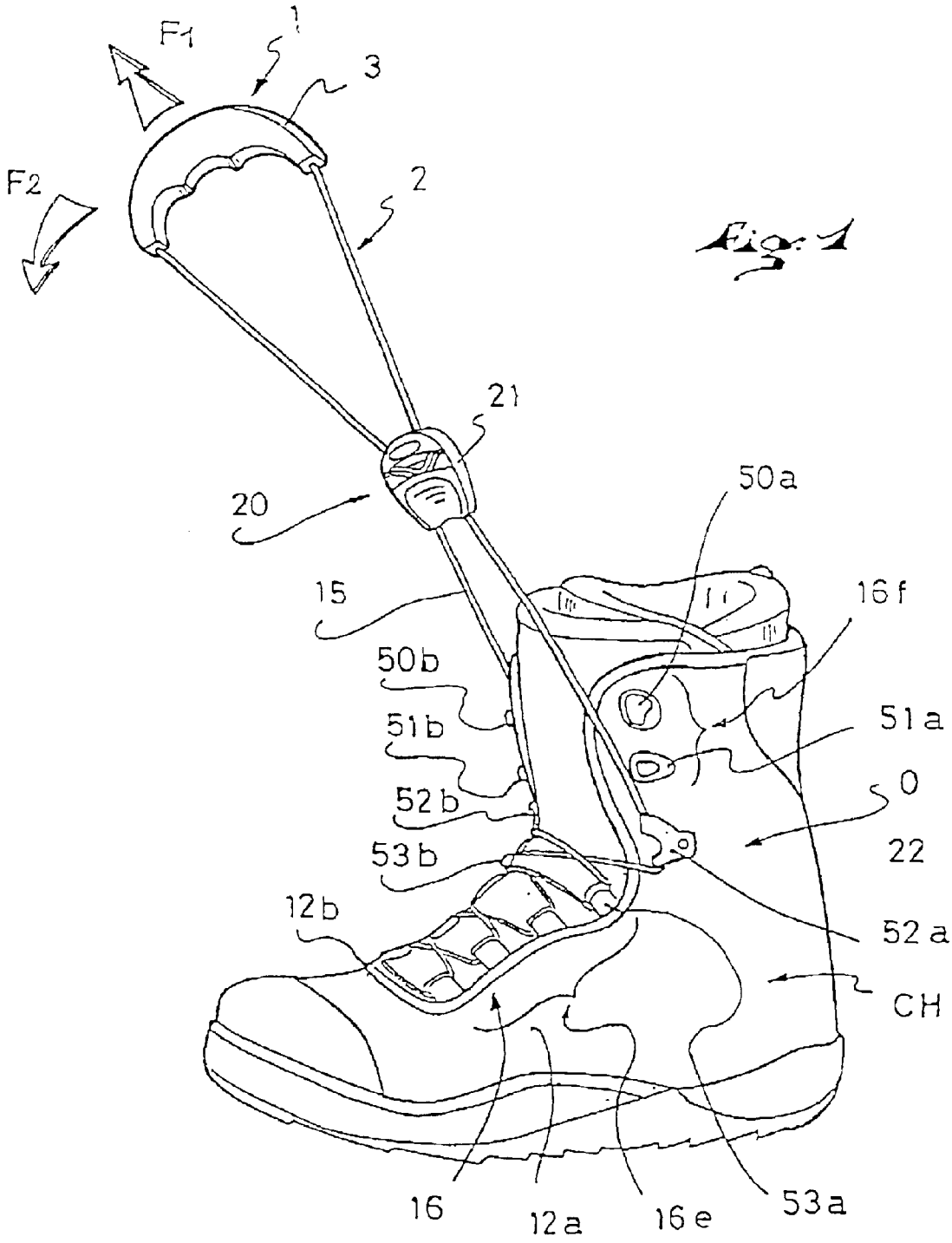
FIG. 1 shows a side view of a footwear equipped with the lace-up device according to the first embodiment in a first tightening phase.

In FIG. 1, the article of footwear CH shown is a snowboard boot. The invention applies to any type of boot whose flexible upper is reinforced either to increase the stiffness in bending of the upper, or to protect the foot and ankle from impacts and external attacks. This type of boot is found in sports such as snowboarding, in-line roller skating, and ice skating, for example.

The invention also applies to boots provided with an external rigid shell made of plastic, for example, and used, in particular, for alpine skiing, snowboarding, in-line roller skating, ice skating, mountain skiing, or telemark skiing, for example.

The article of footwear CH includes an upper O comprising two portions 12*a* and 12*b* adapted to be brought closer together by a lace-up device. This lace-up device generally includes a tightening zone 16, which here is divided into two zones 16*e* and 16*f*, zone 16*e* being a lower tightening zone and zone 16*f* being an upper tightening zone. In a conventional and known manner, the tightening zone 16 comprises return elements 50*a*–54*a* and 50*b*–54*b* positioned on each of the two portions 12*a* and 12*b*, respectively.

A linkage 15, such as a lace or cable, connects at least two return elements 50*a* and 50*b* along a predetermined length of travel. The linkage 15 can advantageously connect all of the return elements to complete the tightening. In addition, the linkage 15 forms a loop 2 located outside the tightening zone 16.

To maintain the tension in the linkage 15, the lace-up device also includes a mechanism 20 for locking, or blocking, the linkage 15.

FIG. 1 more specifically illustrates a first tightening phase of the device, which is adapted to tighten a boot with a high upper. This phase ensures the tightening of the lower tightening zone 16*e*, which extends approximately from the metatarsophalangeal articulation up to the ankle, by making it possible to hold the instep firmly in the article of footwear CH. The lower tightening zone 16*e* includes a series of return elements 53*a* and 53*b* which advantageously specially adapted to make it possible to reduce the friction of the linkage 15 in the return elements.

Despite the use of specially adapted return elements as described in French Application Publication No. 2 706 743, tests have shown that it is preferable to limit to four, for example, the number of return elements 53*a* and 53*b* arranged on each of the portions 12*a* and 12*b* for each tightening zone 16*e* and 16*f* in order to optimize the tightening.

The upper end of the lower tightening zone 16*e* is demarcated by two return elements 52*a* and 52*b*, arranged on each of the portions 12*a* and 12*b* of the upper, which possibly have specific functions which will be detailed subsequently, and which separate the two tightening zones 16*e* and 16*f*.

The linkage 15, which extends from the return elements 52*a* and 52*b*, forms a loop 2 that includes a gripping device 1 arranged on the linkage 15. This gripping device 1 enables the user of the article of footwear CH to grab the loop 2 easily and, likewise, to exert a generally upward force F1 on the loop 2 easily. This force F1 generates a tension in each strand of the linkage 15 that contributes to the tightening power of the lace-up device by bringing the two portions 12*a* and 12*b* of the upper of the article of footwear closer together. However, since the tension in each strand of the linkage 15 corresponds substantially to one half of such force F1, it is important that the gripping device 1 ensure the user's comfort during the tightening.

To achieve this object, the gripping device 1 comprises a rigid frame 3. This rigidity makes it possible to distribute the tension of the linkage 15 over the user's hand by limiting the shearing effect of the linkage on the skin. Thus, the more the pain on the hand is reduced, the more firmly the user can pull on the gripping device 1.

The rigid frame 3 can be advantageously made out of a material having a certain bending strength, in particular thermoplastic materials such as polyamide, polypropylene, and according to an adapted geometry that promotes greater inertia along the direction of force F1.

Once the tension is exerted in the linkage 15, it is necessary to maintain this tightening tension in order to be able to release the gripping device 1. This function is ensured by a locking mechanism 22 that is integrated into the return elements 52*a* and 52*b*. These elements 52*a* and 52*b* simultaneously ensure a sliding function in one direction, and a locking, or blocking, function in another direction. The return elements 52*a*, 52*b*, can be constructed as described in French Application Publication No. 2 757 026.

To combine these two functions, the return elements 52*a* and 52*b* can be suitably oriented on the upper O, such that the force F1 on the linkage 15 makes it possible to slide the linkage in the return elements 52*a* and 52*b*, and also to exert a reverse-locking action. But the return elements 52*a* and 52*b* can also be oriented so as to promote the sliding along the direction of the force F1. Then, once the force F1 has been applied, the user exerts a force F2 oriented substantially forward. This force F2 changes the orientation of the linkage 15 in the return elements 52*a* and 52*b* and makes it possible to use the return elements 52*a* and 52*b* in their locking function.

To facilitate the sequence of the actions of tightening and loosening the lower tightening zone 16*e*, the return elements 52*a*, 52*b*, 53*a*, and 53*b*, which are located in the lower tightening zone 16*e*, include guiding means adapted to prevent the linkage 15 from escaping during the loosening. One way to implement these guiding means consists of using return elements which include a channel from which the linkage 15 cannot escape unexpectedly.

Figure 2:
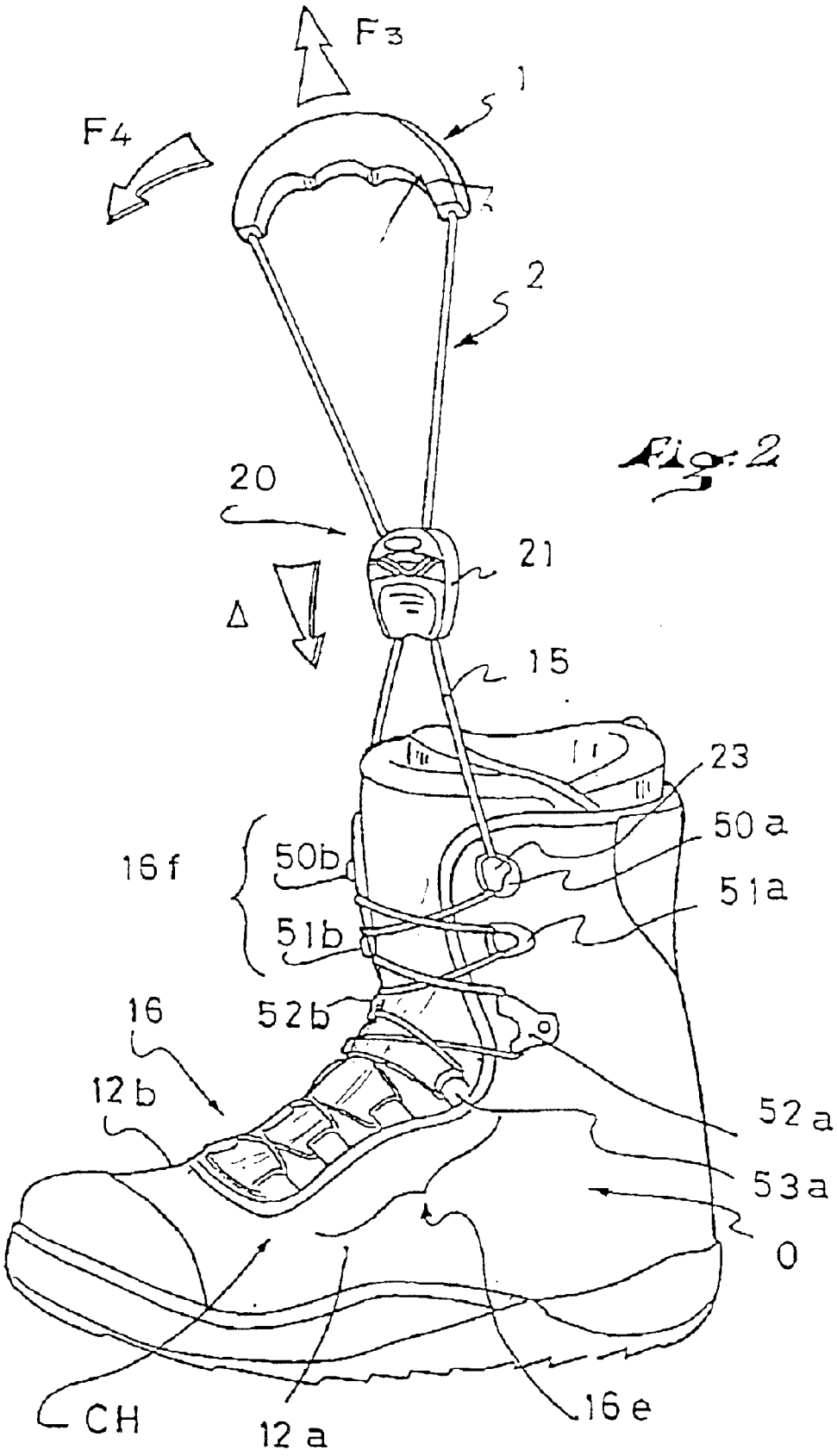
FIG. 2 shows a side view of the footwear equipped with the lace-up device according to the first embodiment in a second tightening phase.

FIG. 2 shows the second and last tightening phase of the footwear CH, which is still a boot adapted to snowboarding. This tightening phase makes it possible to tighten the upper tightening zone 16*f* by bringing the portions 12*a* and 12*b* of the upper O closer together. The lace-up device of the invention, therefore, makes it possible to separate the tightenings and their intensities for the lower tightening zone 16*e* and the upper tightening zone 16*f*. Indeed, the tightening of the upper tightening zone 16*f* does not have any effect on, that is, is independent of, the tightening of the lower tightening zone 16*e* due to the locking function of the linkage 15 which is integrated into the return elements 52*a* and 52*b*.

To undertake the second tightening phase, the user first positions the linkage 15 manually in the return elements 51*a* and 50*a* and their counterparts, located on the opposite portion 12*b*. The user criss-crosses the linkage 15 in a known fashion by going upward from the return element 52*a* to the return element 50*a*. To be able to perform this manual operation, the return elements 50*a*, 50*b*, 51*a*, and 51*b*, located in the upper tightening zone 16*f*, are of the hook type. In other words, they are open so as to retain the linkage 15 in the direction that brings the two portions 12*a* and 12*b* of the upper O closer together.

Once the linkage 15 is positioned, the user pulls, along a substantially upward force F3, on the gripping device 1 which is positioned on the linkage 15 in the area of loop 2. This action tensions the linkage 15 which brings the two portions 12*a* and 12*b* of the upper O closer together, in the area of the upper tightening zone 16*f*. The tightening tension is maintained in this zone 16*f* due to a means for locking the linkage 15.

This locking can be obtained in two different ways. First, the return elements 50*a* and 50*b*, which are positioned at the end of the tightening zone 16, and at the junction of the upper tightening zone 16*f* and the loop 2, integrate a locking means 23. This locking means is substantially similar to the locking means 22 arranged on the return elements 52*a* and 52*b* and described previously. Similarly, the user can lock the linkage 15 by pulling along the direction of the force F3 if the return elements 50*a* and 50*b* are arranged on the upper O along a specific orientation. Conversely, the user pulls on the gripping device 1 with the force F3, then displaces the device 1 forwardly along a direction F4 to ensure the locking of the linkage 15 according to a previously described mechanism.

Second, the locking means 20 can be integrated into an independent locking element 21 that is slidably mounted on the loop 2. To perform the locking, the user pulls on the gripping device 1 along the direction F3, then displaces the locking element 21 along a direction Δ that brings the locking element 21 closer to the return elements 50*a* and 50*b*. Preferably, the locking element 21 is slidably mounted concurrently on the two strands of the loop 2. The locking means 20 can be embodied as two locking elements sliding on each of the strands of the loop 2, respectively. In this case, the user must displace the two locking elements to lock the linkage 15.

Moreover, the two aforementioned locking devices can be combined for increased safety against an ill-timed loosening, which may occur on this type of boot, which can be subject to substantial forces during the sporting activity. FIG. 2 shows this combination with locking means 23 integrated into the return elements 50*a* and 50*b* and the locking element 21 mounted on the loop 2 of the linkage 15.

The tests conducted have shown the interest of using a flexible and substantially non-stretching linkage 15. The flexibility is necessary in the travel imposed by the position of the return elements, and the non-stretching ability makes it possible to limit the elongation of the linkage 15, in particular in the area of the loop 2, during the tightening.

Indeed, the tension obtained by the rigid frame 3 of the gripping device 1 is so substantial that, in the case of a conventional lace, or even a string, the user would spend his energy in untying the lace instead of bringing the two portions 12*a* and 12*b* closer together. The best results were obtained with a linkage 15 obtained with a linkage made of kevlar or aramid, and whose outer diameter is between 2 and 4 mm.

Figure 3:
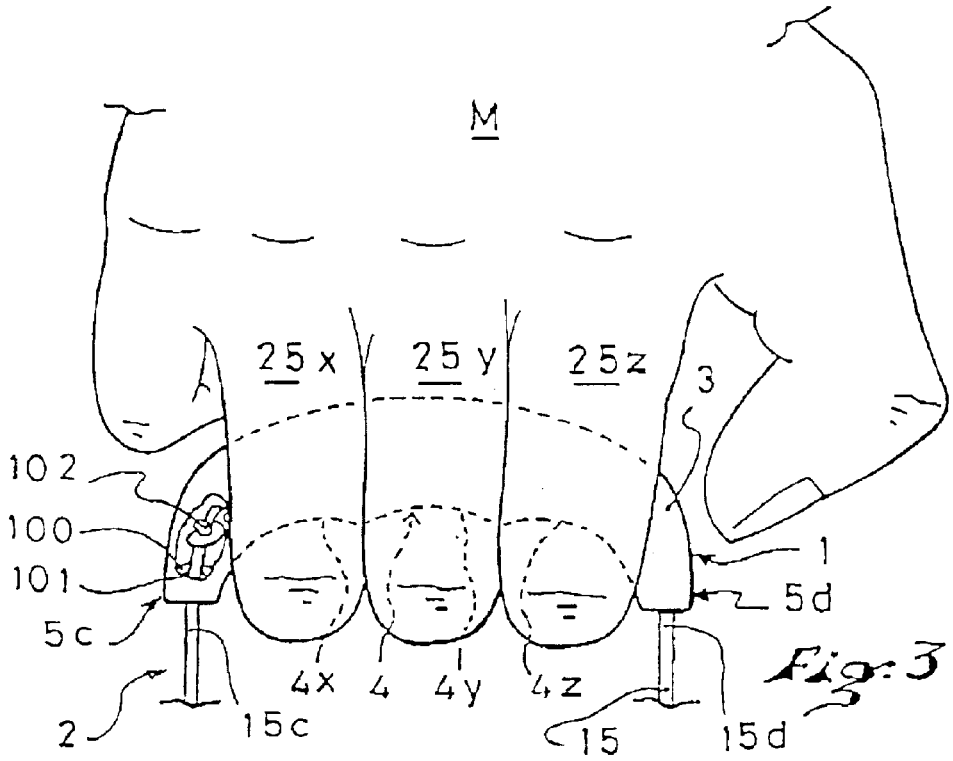
FIG. 3 shows a front view of a detail of the gripping device.

FIG. 3 shows a detail of the lace-up device in the area of the gripping device 1 and its rigid frame 3. This frame 3 comprises a contact surface 4 which is complementary of at least three fingers 25*x*, 25*y*, and 25*z* of the hand M. This contact surface 4 comprises three cavities 4*x*, 4*y*, and 4*z* which assume the morphology of the fingers 25*x*, 25*y*, and 25*z*, respectively, when folded around the frame 3. Tests have shown that to obtain a more powerful tightening, the fingers used preferably are the forefinger, second finger, and third finger.

In addition, in the preferred embodiment shown, the frame 3 also serves to close the loop 2 constituted by the linkage 15. The gripping device 1 includes hooking zones, or connection arrangements, 5*c* and 5*d* that are adapted to cooperate with the two ends, or end portions, 15*c* and 15*d*, respectively, of the linkage 15. The connection arrangements 5*c*, 5*d* can be constituted by a wall 100, perpendicular to the linkage 15, which is integral with the rigid frame 3. A hole 101 in which the end 15*c* of the linkage 15 passes is provided in this wall 100. This end 15*c* is equipped with a locking means, such as a knot 102 whose diameter is greater than the diameter of the hole 101.

Figure 4:
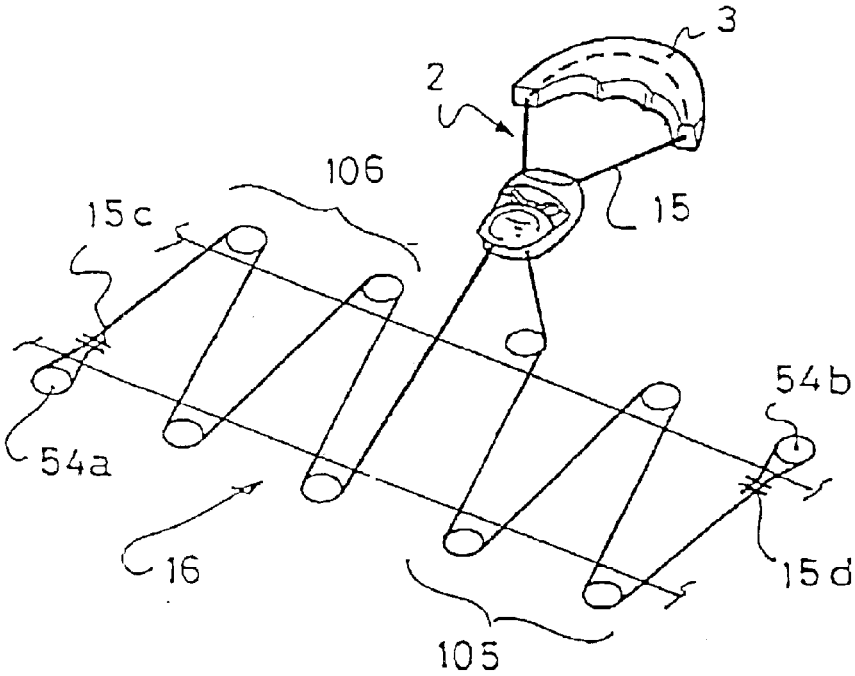
FIG. 4 shows a three-quarter top view of the lace-up device according to the second embodiment.

As shown in FIG. 4, the linkage 15 can also extend right through the frame 3. However, like the gripping device shown in FIG. 3, the frame 3 serves to separate, i.e., to space apart, the linkage portions that are connected to, or pass through, the frame to allow the fingers of the hand to extend within the loop 2. The ends 15*c* and 15*d*, or end portions, of the linkage 15 are connected to return elements 54*a* and 54*b* located substantially at the ends of the tightening zone 16. However, in this embodiment, the loop 2 which includes the frame 3 is not located at one of the ends of the tightening zone 16. The loop 2 is located outside the tightening zone 16, but extends substantially perpendicular to the plane defined by the tightening zone 16 so as to divide the zone 16 into two tightening sub-zones 105 and 106.

Furthermore, the gripping device can be provided with an improvement not shown. In this improvement, the gripping device includes a fastening means complementary of the article of footwear which makes it possible to store the gripping device on the article of footwear. This fastening means can advantageously be of the self-gripping type, or in the form of a snap-fastener. The footwear can also be provided with a pocket or a strap forming a loop in which the gripping device could be housed when it is out of the tightening and loosening phases. In addition, the gripping device can advantageously include comfort elements constituted of a softer material than that of the frame, and positioned in the area of the contact surface adapted to be in contact with the fingers of the hand.

The invention is not limited to the embodiments described hereinabove, which are provided for guidance only, but encompasses all similar or equivalent embodiments.

What is claimed is:

1. A tight lace-up device adapted to equip footwear, the footwear including two portions to be brought closer together with said device, said device comprising:

a tightening zone comprising return elements positioned on said portions;

a linkage including two ends, said linkage connecting, along a predetermined path, at least two return elements arranged on different respective ones of said footwear portions, said linkage forming a loop outside said tightening zone;

a means for locking said linkage;

a gripping device arranged on said linkage in an area of said loop, said gripping device enabling a user to pull efficiently on said linkage with at least one hand, said gripping device comprising a frame for distributing tension of said linkage over a hand of the user.

2. A lace-up device according to claim 1, wherein said frame is rigid.

3. A lace-up device according to claim 2, wherein said frame comprises a contact surface complementary of at least three fingers of the hand of the user.

4. A lace-up device according to claim 1, wherein said gripping device includes a hooking means adapted to cooperate with said two ends of said linkage and thus closing said loop.

5. A lace-up device according to claim 1, wherein said locking means is integrated into said return elements positioned at a junction of said tightening zone and said loop, for maintaining tension in said tightening zone.

6. A lace-up device according to claim 1, wherein said tightening zone comprises at least two zones separated by at least one return element positioned on each of said portions of said footwear, and wherein said locking means is integrated into said return elements for maintaining said tightening tension in a lower one of said two zones of said tightening zone, said lower zone being separated from said gripping device by said return elements.

7. A lace-up device according to claim 6, wherein said return elements, located in said lower tightening zone, include guiding means adapted to prevent said linkage from escaping during loosening.

8. A lace-up device according to claim 6, wherein said return elements, located in an upper one of said two zones of said tightening zone, are of a hook type for manually positioning said linkage in said return elements.

9. A lace-up device according to claim 1, wherein said linkage is flexible and substantially non-stretchable.

10. A lace-up device according to claim 1, wherein said locking means is integrated into a locking element outside said tightening zone, said locking element being slidably mounted on said loop.

11. A lace-up device according to claim 1, wherein said loop is formed by two portions of said linkage outside said tightening zone, said frame of said gripping device serving to space apart said two portions of said linkage a predeterminate fixed distance during tightening of said linkage.

12. A lace-up device according to claim 1, wherein said loop is formed by two portions of said linkage outside said tightening zone, said two portions of said linkage being connected to said frame of said gripping device at two spaced-apart locations of said frame.

13. A lace-up device according to claim 1, wherein said tightening zone consists of a lower tightening zone comprising return elements on a lower portion of the footwear and an upper tightening zone comprising return elements on an upper portion of the footwear, said means for locking said linkage being integrated in said return elements of said lower tightening zone for maintaining a tightening tension in said lower tightening zone.

14. A lace-up device according to claim 1, wherein said locking means comprises a locking structure contained within each of at least said two return elements, said locking means further comprising a locking element slidably mounted on said loop, said locking element being separate of said locking structure contained within said two return elements.

15. A lace-up device according to claim 3, wherein said contact surface comprises at least three successively arranged cavities, each of said three cavities corresponding to a respective one of three fingers of the hand of the user.

16. A lace-up device according to claim 6, wherein said means for locking said linkage comprises means for maintaining said tension in said lower one of said two tightening zones independent of, and different from, a tension in an upper one of said two tightening zones.

17. A lace-up device adapted to equip footwear, the footwear including two portions to be brought closer together with said device, said device comprising:

a tightening zone comprising return elements positioned on said portions;

a linkage including two ends, said linkage connecting, along a predetermined path, at least two return elements arranged on different respective ones of said footwear portions for applying a tightening tension on said linkage in said tightening zone, said linkage being slidable with respect to said return elements;

a linkage tension maintaining structure to maintain said tightening tension on said linkage in said tightening zone;

said linkage comprising two linkage portions forming a loop outside said tightening zone;

a gripping device arranged on said linkage in an area of said loop, said gripping device comprising a frame serving to space apart said two portions of said linkage to allow fingers of a hand of a user to extend within said loop, to engage said frame, and to pull on said linkage with said hand.

18. A lace-up device according to claim 17, wherein said linkage tension maintaining structure is integrated within said return elements positioned at a junction of said tightening zone and said loop.

19. A lace-up device according to claim 17, wherein said linkage tension maintaining structure comprises a locking structure contained within each of at least said two return elements, said linkage tension maintaining structure further comprising a locking element slidably mounted on said loop.

20. A lace-up device according to claim 17, wherein said tightening zone comprises at least two zones separated by at least one return element positioned on each of respective ones of said portions of said footwear lower than an uppermost return element in said tightening zone, and wherein said locking means comprises means for maintaining a tension in a first of said two tightening zones independent of a tension in a second of said two tightening zones.

21. An article of footwear comprising:

an upper comprising two portions to be brought closer together to tighten the article of footwear upon a foot;

a lace-up device comprising:

a tightening zone comprising at least two return elements positioned on respective ones of said portions of said upper;

a linkage including two ends, said linkage connecting, along a predetermined path, at least said two return elements for applying a tightening tension on said linkage in said tightening zone, said linkage being slidable with respect to said two return elements;

a linkage tension maintaining structure to maintain said tightening tension on said linkage in said tightening zone;

said linkage comprising two linkage portions forming a loop outside said tightening zone;

a gripping device arranged on said linkage in an area of said loop, said gripping device comprising a frame serving to space apart said two portions of said linkage to allow fingers of a hand of a user to extend within said loop, to engage said frame, and to pull on said linkage with said hand.

22. An article of footwear according to claim 21, wherein said linkage tension maintaining structure is integrated within said return elements positioned at a junction of said tightening zone and said loop.

23. An article of footwear according to claim 21, wherein said linkage tension maintaining structure comprises a locking structure contained within each of at least said two return elements, said linkage tension maintaining structure further comprising a locking element slidably mounted on said loop, said locking element being separate of said locking structure contained within said two return elements.

24. An article of footwear according to claim 21, wherein said upper is a high upper, said high upper including a lower portion extending to an area of an ankle of a foot and an upper portion extending above the lower portion.

25. An article of footwear according to claim 24, wherein said tightening zone comprises a lower zone for tightening said lower portion of said upper and an upper zone for tightening said upper portion of said upper, said lower and upper zones being separated by at least one return element positioned on each of respective ones of said portions of said upper.

26. An article of footwear according to claim 25, wherein said linkage tension maintaining structure comprises means for maintaining a tension in said lower tightening zone independent of and different from a tension in said upper tightening zone.

27. An article of footwear according to claim 26, wherein said linkage comprises one and only one lacing extending through said lower and upper tightening zones.

28. An article of footwear according to claim 26, wherein said linkage is continuous from a bottom of said lower tightening zone to a top of said upper tightening zone.

29. An article of footwear according to claim 26, wherein said lower tightening zone extends from a metatarsophalangeal articulation area to an ankle area.

30. An article of footwear according to claim 21, wherein said tightening zone comprises at least two zones separated by at least one return element positioned on each of respective ones of said portions of said upper, and wherein said linkage tension maintaining structure comprises means for maintaining a tension in a first of said two tightening zones independent of a tension in a second of said two tightening zones.

31. An article of footwear according to claim 21, wherein said frame of said gripping device is rigid.

32. An article of footwear according to claim 1, wherein said frame of said gripping device is rigid.

33. A lace-up device according to claim 32, wherein said fixed distance is less than a width of a hand of the user.

34. A lace-up device according to claim 32, wherein said frame comprises a contact surface complementary of no greater than three fingers of the hand of the user.

35. A lace-up device according to claim 17, wherein said frame of said gripping device is rigid.

36. A lace-up device according to claim 17, wherein said frame serves to space apart said two portions of said linkage a fixed distance during tensioning of said linkage.

37. An article of footwear according to claim 21, wherein said frame serves to space apart said two portions of said linkage a fixed predeterminate distance during tensioning of said linkage.

38. An article of footwear according to claim 21, wherein said linkage is connected to said gripping device during use of said article of footwear.

39. A sports boot comprising:

an upper comprising two portions to be brought closer together to tighten the article of footwear upon a foot;

a lace-up device comprising:

a tightening zone comprising at least two return elements positioned on respective ones of said portions of said upper;

a lace including two ends, said lace connecting, along a predetermined path, at least two return elements for applying a tightening tension on said lace in said tightening zone, said lace being slidable with respect to said two return elements;

a lace tension maintaining structure to maintain said tightening tension on said lace in said tightening zone;

said lace comprising two lace portions extending from said tightening zone;

a gripping device connected to both of said two lace portions, said two lace portions and said gripping device constituting a loop extending away from said upper;

said gripping device having a non-uniform cross section along a length extending between said two lace portions;

said gripping device spacing apart said two lace portions to allow fingers of a hand of a user to extend within said loop, grip said gripping device, and apply a tensioning force to said lace.

40. A sports boot according to claim 39, wherein said gripping device is rigid.

41. A sports boot according to claim 39, wherein said gripping device serves to space apart said two lace portions a fixed predeterminate distance during tensioning of said lace.

42. A sports boot according to claim 39, wherein said gripping device has a maximum cross section along said length multiple times a transverse cross section of said lace.

43. A sports boot according to claim 39, wherein said lace is connected to said gripping device during use of said boot.

44. A tight lace-up device adapted to equip footwear, the footwear including two portions to be brought closer together with said device, said device comprising:

a tightening zone comprising return elements positioned on said portions;

a linkage including two ends, said linkage connecting, along a predetermined path, at least two return elements arranged on different respective ones of said footwear portions, said linkage forming a loop outside said tightening zone;

a means for locking said linkage;

a gripping device arranged on said linkage, said gripping device enabling a user to pull efficiently on said linkage with at least one hand, said gripping device comprising a frame for distributing tension of said linkage over a hand of the user.

45. A tight lace-up device adapted to equip footwear, the footwear including two portions to be brought closer together with said device, said device comprising:

a tightening zone comprising return elements positioned on said portions;

a linkage including two ends, said linkage connecting, along a predetermined path, at least two return elements arranged on different respective ones of said footwear portions, said linkage forming a loop outside said tightening zone;

a means for locking said linkage;

a gripping device arranged on said linkage, said gripping device enabling a user to pull efficiently on said linkage with at least one hand, said gripping device comprising a rigid frame for distributing tension of said linkage over a hand of the user.

46. A tight lace-up device adapted to equip footwear, the footwear including two portions to be brought closer together with said device, said device comprising:

a tightening zone comprising return elements positioned on said portions, said tightening zone further comprising at least two zones separated by at least one return element positioned on each of said portions of said footwear;

a linkage including two ends, said linkage connecting, along a predetermined path, at least two return elements arranged on different respective ones of said footwear portions, said linkage forming a loop outside said tightening zone;

a means for locking said linkage, said locking means being integrated into said return elements for maintaining said tightening tension in a lower one of said two zones of said tightening zone, said lower zone being separated from said gripping device by said return elements;

a gripping device arranged on said linkage, said gripping device enabling a user to pull efficiently on said linkage with at least one hand, said gripping device comprising a frame for distributing tension of said linkage over a hand of the user.

* * * * *